US009115328B2

(12) United States Patent
Toda

(10) Patent No.: US 9,115,328 B2
(45) Date of Patent: Aug. 25, 2015

(54) GEAR OIL COMPOSITION

(75) Inventor: Masatoshi Toda, Chiba (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 248 days.

(21) Appl. No.: 13/259,698

(22) PCT Filed: Mar. 26, 2010

(86) PCT No.: PCT/JP2010/055422

§ 371 (c)(1),
(2), (4) Date: Nov. 3, 2011

(87) PCT Pub. No.: WO2010/110442

PCT Pub. Date: Sep. 30, 2010

(65) Prior Publication Data

US 2012/0040874 A1 Feb. 16, 2012

(30) Foreign Application Priority Data

Mar. 27, 2009 (JP) ..... 2009-080478

(51) Int. Cl.

| | |
|---|---|
| ***C10M 169/04*** | (2006.01) |
| ***C10M 143/04*** | (2006.01) |
| ***C10M 135/18*** | (2006.01) |
| ***C10M 135/22*** | (2006.01) |
| ***C10M 137/04*** | (2006.01) |
| ***C10M 137/10*** | (2006.01) |

(52) U.S. Cl.

CPC ... *C10M 169/044* (2013.01); *C10M 2203/1006* (2013.01); *C10M 2205/022* (2013.01); *C10M 2205/0285* (2013.01); *C10M 2209/084* (2013.01); *C10M 2215/28* (2013.01); *C10M 2219/068* (2013.01); *C10M 2219/08* (2013.01); *C10M 2219/082* (2013.01); *C10M 2223/04* (2013.01); *C10M 2223/041* (2013.01); *C10M 2223/045* (2013.01); *C10M 2223/047* (2013.01); *C10M 2223/049* (2013.01); *C10M 2227/066* (2013.01); *C10N 2210/06* (2013.01); *C10N 2220/021* (2013.01); *C10N 2220/022* (2013.01); *C10N 2230/02* (2013.01); *C10N 2230/06* (2013.01); *C10N 2230/54* (2013.01); *C10N 2230/68* (2013.01); *C10N 2240/04* (2013.01)

(58) Field of Classification Search

USPC ..... 508/364, 591, 569, 564

See application file for complete search history.

(56) References Cited

U.S. PATENT DOCUMENTS

| | | | | |
|---|---|---|---|---|
| 4,853,139 | A | 8/1989 | Ichihashi | |
| 2002/0119895 | A1 * | 8/2002 | Cook et al. | 508/186 |
| 2004/0147410 | A1 | 7/2004 | Milner et al. | |
| 2004/0214729 | A1 | 10/2004 | Buitrago | |
| 2006/0199896 | A1 * | 9/2006 | Walton et al. | 524/543 |
| 2008/0234153 | A1 | 9/2008 | Matsui | |
| 2008/0300155 | A1 | 12/2008 | Buitrago | |
| 2009/0312211 | A1 | 12/2009 | Yamada et al. | |

FOREIGN PATENT DOCUMENTS

| | | |
|---|---|---|
| CN | 101280240 A | 10/2008 |
| JP | 63 280796 | 11/1988 |
| JP | 08 209168 | 8/1996 |
| JP | 2000 328084 | 11/2000 |
| JP | 2004 217797 | 8/2004 |
| JP | 2004 323850 | 11/2004 |
| JP | 2008 231189 | 10/2008 |
| WO | 2008 016038 | 2/2008 |

OTHER PUBLICATIONS

International Search Report Issued Jun. 29, 2010 in PCT/JP10/055422 Filed Mar. 26, 2010.

Office Action and Search Report issued on Mar. 7, 2013, in Chinese Patent Application No. 201080015644.8 with English translation of category of cited documents.

* cited by examiner

*Primary Examiner* — James Goloboy

(74) *Attorney, Agent, or Firm* — Oblon, McClelland, Maier & Neustadt, L.L.P.

(57) ABSTRACT

A particular gear oil composition is provided that contains (A) a base oil, (B) an ethylene-α-olefin copolymer, (C) a sulfur-containing compound, (D) an organomolybdenum compound and (E) a phosphorus-containing compound, which is excellent in extreme pressure properties, shear stability and wear resistance, and is excellent in fuel saving properties.

20 Claims, No Drawings

GEAR OIL COMPOSITION

CROSS REFERENCE TO RELATED APPLICATION

This application is a 371 of PCT/JP2010/055422, filed on Mar. 26, 2010, and claims priority to Japanese Patent Application No. 2009-080478, filed on Mar. 27, 2009.

TECHNICAL FIELD

The present invention relates to a gear oil composition, and specifically relates to a gear oil composition that is excellent in extreme pressure properties, shear stability and wear resistance, and is excellent in fuel saving properties.

BACKGROUND ART

A gear oil is a lubricating oil for a gear device, and is used for preventing damages and seizing of gears, for a high-speed and high load gear for an automobile or the like, a relatively low load gear for an ordinary machinery, a relatively high load gear for an ordinary machinery, and the like. The gear oil is generally demanded to be excellent in extreme pressure properties, and particularly, extreme pressure properties are important for a differential gear oil, as compared to MTF (manual transmission fluid). Enhancement in various other properties are also demanded corresponding to the purposes, and various technological developments have been made. For example, Patent Documents 1 and 2 disclose a lubricating oil composition containing a particular ethylene-α-olefin copolymer. The lubricating oil composition is a lubricating oil composition that is excellent in temperature characteristics and is excellent in shear stability. The characteristics that are demanded for a gear oil also include wear resistance, oxidation stability, thermal stability and the like, in addition to the above.

In addition to these capabilities, enhancement of fuel saving properties is demanded for a gear oil for an automobile and the like. As a method for enhancing the fuel saving properties, for example, the use of a gear oil having a low viscosity may be considered for decreasing the viscosity resistance, but the method may suffer shortage of an oil film, which causes additional problems, e.g., deterioration of the seizing resistance and deterioration of the fatigue life of the bearing and gear. It is thus difficult to achieve both the enhancement of fuel saving properties and the basic capabilities of the gear oil simultaneously, and further technological developments have been demanded.

RELATED ART DOCUMENTS

Patent Documents

[Patent Document 1] JP-A-63-280796
[Patent Document 2] JP-A-11-323370

SUMMARY OF THE INVENTION

Problems to be Solved by the Invention

The present invention has been made under the circumstances, and an object thereof is to provide a gear oil composition that is excellent in extreme pressure properties, shear stability and wear resistance, and is excellent in fuel saving properties.

Means for Solving the Problems

As a result of earnest investigations made by the inventors paying attention to the friction coefficient and the traction coefficient under the boundary lubrication condition (i.e., the friction coefficient in the mixed lubrication region), it has been found that the problems are solved by combining a particular base oil and particular additives. The present invention has been completed based on the finding.

Accordingly, the present invention provides:

1. A gear oil composition containing:

(A) a base oil having a viscosity index of 120 or more and containing at least one member selected from a mineral oil having a kinematic viscosity at 100° C. of from 2 to 20 $mm^2/s$ and a polyolefin synthetic oil having a kinematic viscosity at 100° C. of from 2 to 20 $mm^2/s$;

(B) an ethylene-α-olefin copolymer having a number average molecular weight of from 2,000 to 10,000;

(C) a sulfur-containing compound represented by the following general formula (I):

$$R^1—S_x—R^2 \quad (I)$$

in the general formula (I), $R^1$ and $R^2$ each independently represent a hydrocarbon group having from 4 to 16 carbon atoms, and x represents an integer of from 2 to 4;

(D) an organomolybdenum compound; and (E) a phosphorus-containing compound having a hydrocarbon group having from 2 to 24 carbon atoms selected from a phosphate ester compound, a phosphite ester compound, a thiophosphate ester compound and a thiophosphite ester compound, the composition having a content of the component (B) of from 3 to 10% by mass, a content of the component (C) of from 1.2 to 2.0% by mass in terms of sulfur atom, a content of the component (D) of from 100 to 300 ppm by mass in terms of molybdenum atom, and a content of the component (E) of from 0.15 to 0.2% by mass in terms of phosphorus atom, based on a total amount of the composition, and having a mass ratio of sulfur atom to phosphorus atom (S/P) in the composition of from 8 to 11.

2. The gear oil composition according to the item 1, wherein the base oil as the component (A) is a base oil that contains a mineral oil having a viscosity index of 125 or more and/or a polyolefin synthetic oil having a viscosity index of 125 or more in a content of 40% by mass or more based on a total amount of the base oil.

3. The gear oil composition according to the item 1 or 2, wherein the base oil as the component (A) is a base oil that contains a mineral oil.

4. The gear oil composition according to any one of the items 1 to 3, wherein the organomolybdenum compound as the component (D) is a molybdenum dithiophosphate and/or a molybdenum dithiocarbamate.

Advantages of the Invention

According to the present invention, a gear oil composition that is excellent in extreme pressure properties, shear stability and wear resistance, and is excellent in fuel saving properties is provided.

EMBODIMENTS FOR CARRYING OUT THE INVENTION

The gear oil composition of the present invention contains (A) a base oil, (B) an ethylene-α-olefin copolymer, (C) a sulfur-containing compound, (D) an organomolybdenum compound and (E) a phosphorus-containing compound.

The base oil as the component (A) in the present invention is a base oil having a viscosity index of 120 or more and containing at least one member selected from a mineral oil having a kinematic viscosity at 100° C. of from 2 to 20 $mm^2/s$ and a polyolefin synthetic oil having a kinematic viscosity at 100° C. of from 2 to 20 $mm^2/s$.

When the kinematic viscosity at 100° C. is less than 2 $mm^2/s$, problems may occur that the strength of the oil film is insufficient at a high temperature, and the vaporization loss is increased. When it exceeds 20 $mm^2/s$, the power loss due to viscosity resistance may be increased. From this point of view, the kinematic viscosity at 100° C. is preferably from 4 to 13 $mm^2/s$, and more preferably from 6 to 11 $mm^2/s$.

The mineral oil used as the base oil as the component (A) may be any one that satisfies the aforementioned characteristics without limitation, and examples thereof include a refined oil obtained by refining according to an ordinary method a distilled oil obtained by distillation under ordinary pressure of a paraffin base crude oil or an intermediate base crude oil or by distillation under reduced pressure of the residual oil of the distillation under ordinary pressure, and a deeply dewaxed oil obtained by subjecting the refined oil to a deep dewaxing treatment. The refining method is not particularly limited, and various methods may be considered. In general, (a) a hydrogenation treatment, (b) a dewaxing treatment (solvent dewaxing or hydrogenation dewaxing), (c) a solvent extraction treatment, (d) an alkali distillation or sulfuric acid washing treatment and (e) a white clay treatment may be employed solely or as a combination in an appropriate order. It is effective to perform the same treatment repeatedly in multiple stages. Examples thereof include (1) a method of subjecting a distilled oil to a hydrogenation treatment, or subjecting to a hydrogenation treatment and then an alkali distillation or sulfuric acid washing treatment, (2) a method of subjecting a distilled oil to a hydrogenation treatment and then a dewaxing treatment, (3) a method of subjecting a distilled oil to a solvent extraction treatment and then a hydrogenation treatment, (4) a method of subjecting a distilled oil to a two-stage or three-stage hydrogenation treatment, or further subjecting thereafter to an alkali distillation or sulfuric acid washing treatment, and (5) a method of subjecting a distilled oil to a method, such as the methods (1) to (4), and then subjecting again to a dewaxing treatment to provide a deeply dewaxed oil. In these methods, the conditions may be appropriately controlled depending on the properties of the target base oil.

Examples of the polyolefin synthetic oil include a homopolymer or copolymer of an α-olefin, polybutene, and hydrogenated products thereof, and an oligomer of an α-olefin having from 6 to 14 carbon atoms, such as a decene oligomer, an ethylene-α-olefin copolymer, such as an ethylene-propylene copolymer, polybutene, and hydrogenated products thereof are preferred owing to the high viscosity index thereof.

As the base oil in the present invention, the mineral oil may be used solely or as a combination of two or more kinds thereof. The polyolefin synthetic oil may be used solely or as a combination of two or more kinds thereof. Furthermore, at least one of the mineral oil and at least one of the polyolefin synthetic oil may be used in combination.

In the present invention, the base oil having a viscosity index of 120 or more is used. The combination of the base oil having a viscosity index of 120 or more with the component (B) provides performance excellent in both traction coefficient and shear stability.

The base oil used in the present invention is preferably a base oil that contains a mineral oil having a viscosity index of 125 or more and/or a polyolefin synthetic oil having a viscosity index of 125 or more in a content of 40% by mass or more, and more preferably 60% by mass or more, based on the total amount of the base oil. The combination of the base oil satisfying the condition with the component (B) provides performance further excellent in both traction coefficient and shear stability.

The base oil as the component (A) of the present invention is preferably a base oil that contains a mineral oil, and is more preferably a mineral oil obtained by a deep dewaxing treatment, from the stand point of economy and dissolution properties of various additives. The deep dewaxing treatment may be performed by a solvent dewaxing treatment under severe conditions or a contact hydrogenation dewaxing treatment with a zeolite catalyst.

The ethylene-α-olefin copolymer of the component (B) in the present invention is an ethylene-α-olefin copolymer having a number average molecular weight of from 2,000 to 10,000. When the number average molecular weight is less than 2,000, the effect of increasing the viscosity index is insufficient, and when it exceeds 10,000, the shear stability is unfavorably deteriorated. From this point of view, the number average molecular weight is more preferably from 3,000 to 8,000. The ethylene-α-olefin copolymer may be a copolymer of ethylene with an α-olefin having from 3 to 20 carbon atoms, such as propylene, 1-butene and 1-decene, and does not contain a polar group. In the present invention, the ethylene-α-olefin copolymer as the component (B) may be used solely or as a combination of two or more kinds thereof.

In the present invention, the ethylene-α-olefin copolymer as the component (B) is mixed in a content of from 3 to 10% by mass, and preferably from 4.5 to 8.5% by mass, based on the total amount of the gear oil composition. When the content is less than 3% by mass, the effect of decreasing the traction coefficient and the effect of increasing the viscosity index are insufficient, and when it exceeds 10% by mass, advantages comparable to the mixed amount is not obtained, and the shear stability is deteriorated.

In the present invention, the combination of the base oil as the component (A) and the ethylene-α-olefin copolymer as the component (B) is used. The combination use thereof decreases the traction coefficient without deteriorating the shear stability, and provides the effect of enhancing the fuel saving properties. It has been known that the use of a polyolefin synthetic oil as a base oil decreases the traction coefficient, but in the present invention, the effect equivalent to the known technique is obtained even in the case where a mineral oil is used as the base oil. Accordingly, advantages are obtained in the stand point of economy and dissolution properties of various additives, as described above.

The sulfur-containing compound as the component (C) in the present invention is a sulfur-containing compound represented by the following general formula (I):

$$R^1—S_x—R^2 \quad (I)$$

In the general formula (I), $R^1$ and $R^2$ each independently represent a hydrocarbon group having from 4 to 16 carbon atoms, which may be linear or branched. When the number of carbon atoms is less than 4, the wear resistance may be deteriorated, and when it exceeds 16, the oxidation stability may be deteriorated. From this point of view, the number of carbon atoms is preferably from 6 to 14, and more preferably from 8 to 10. A branched chain is preferred owing to the excellent oxidation stability thereof, and specific examples thereof include a t-butyl group. In the general formula (I), x represents an integer of from 2 to 4. When x is less than 2, the extreme pressure properties may be deteriorated, and when it exceeds 4, the oxidation stability may be deteriorated. From this point of view, x is preferably 2 or 3. Specific examples of the compound include di-t-butyl disulfide and di-t-butyl trisulfide. In the present invention, the sulfur-containing compound as the component (C) may be used solely or as a combination of two or more kinds thereof.

In the present invention, the sulfur-containing compound as the component (C) is mixed in a content of from 1.2 to 2.0% by mass, and preferably from 1.6 to 1.9% by mass, in terms of sulfur atom based on the total amount of the gear oil composition. When the content is less than 1.2% by mass, the extreme pressure properties is deteriorated, and when it exceeds 2.0% by mass, the amount of sludge generated is increased.

The organomolybdenum compound as the component (D) in the present invention may be an organomolybdenum compound that has been used as an additive for a lubricating oil, examples of which include a molybdenum dithiophosphate (MoDTP) and a molybdenum dithiocarbamate (MoDTC), and a molybdenum dithiocarbamate is preferred.

Examples of the molybdenum dithiocarbamate include a sulfurized oxymolybdenum dithiocarbamate represented by the general formula (II):

[Ka 1]

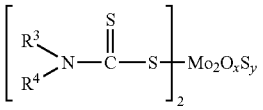

(II)

wherein $R^3$ and $R^4$ each represent a hydrocarbon group having from 4 to 24 carbon atoms, and x and y each represent a number of from 1 to 3, provided that the sum of x and y is 4.

Examples of the hydrocarbon group having from 4 to 24 carbon atoms include an alkyl group having from 4 to 24 carbon atoms, an alkenyl group having from 4 to 24 carbon atoms, an aryl group having from 6 to 24 carbon atoms and an arylalkyl group having from 7 to 24 carbon atoms. When the number of carbon atoms of the hydrocarbon group is 4 or more, favorable solubility in the base oil is obtained, and when the number of carbon atoms is 24 or less, advantages are favorably provided, and the compound is readily available. The groups of $R^3$ and $R^4$ may be the same as or different from each other.

The alkyl group having from 4 to 24 carbon atoms and the alkenyl group having from 4 to 24 carbon atoms may be either linear, branched or cyclic, and examples thereof include a n-butyl group, an isobutyl group, a sec-butyl group, a tert-butyl group, various kinds of hexyl groups, various kinds of octyl groups, various kinds of decyl groups, various kinds of dodecyl groups, various kinds of tetradecyl groups, various kinds of hexadecyl groups, various kinds of octadecyl groups, various kinds of eicosyl groups, a cyclopentyl group, a cyclohexyl group, an oleyl group and a linoleyl group. The aryl group having from 6 to 24 carbon atoms and the arylalkyl group having from 7 to 24 carbon atoms may have one or more substituents, such as an alkyl group, on the aromatic ring thereof, and examples thereof include a phenyl group, a tolyl group, a xylyl group, a naphthyl group, a butylphenyl group, an octylphenyl group, a nonylphenyl group, a benzyl group, a methylbenzyl group, a butylbenzyl group, a phenethyl group, a methylphenethyl group and a butylphenethyl group.

In the present invention, the organomolybdenum compound as the component (D) may be used solely or as a combination of two or more kinds thereof.

In the present invention, the content of the organomolybdenum compound as the component (D) is from 100 to 300 ppm by mass, and preferably from 150 to 200 ppm by mass, in terms of molybdenum atom based on the total amount of the gear oil composition. When the content is less than 100 ppm by mass, it is difficult to decrease the friction coefficient under the boundary lubrication condition, and when it exceeds 300 ppm by mass, the oxidation stability and the storage stability are deteriorated.

The phosphorus-containing compound as the component (E) in the present invention is a phosphorus-containing compound having a hydrocarbon group having from 2 to 24 carbon atoms selected from a phosphate ester compound, a phosphite ester compound, a thiophosphate ester compound and a thiophosphite ester compound.

Examples of the phosphate ester compound include a phosphate triester or acid phosphate ester compound represented by the general formula (III):

$$(R^5O)_mP(=O)(OH)_{3-m} \quad \text{(III)}$$

wherein $R^5$ represents a hydrocarbon group having from 2 to 24 carbon atoms, and m represents 1, 2 or 3. When m is 2 or 3, $R^5O$ may be the same as or different from each other.

Examples of the hydrocarbon group having from 2 to 24 carbon atoms represented by $R^5$ in the general formula (III) include an alkyl group and an alkenyl group each having from 2 to 24 carbon atoms, an aryl group having from 6 to 24 carbon atoms and an aralkyl group having from 7 to 24 carbon atoms.

The alkyl group and the alkenyl group may be either linear, branched or cyclic, and examples thereof include an ethyl group, a n-propyl group, an isopropyl group, a n-butyl group, an isobutyl group, a sec-butyl group, a tert-butyl group, various kinds of pentyl groups, various kinds of hexyl groups, various kinds of octyl groups, various kinds of decyl groups, various kinds of dodecyl groups, various kinds of tetradecyl groups, various kinds of hexadecyl groups, various kinds of octadecyl groups, various kinds of nonadecyl groups, various kinds of eicosyl groups, various kinds of heneicosyl groups, various kinds of docosyl groups, various kinds of tricosyl groups, various kinds of tetracosyl groups, a cyclopentyl group, a cyclohexyl group, an allyl group, a propenyl group, various kinds of butenyl groups, various kinds of hexenyl groups, various kinds of octenyl groups, various kinds of decenyl groups, various kinds of dodecenyl groups, various kinds of tetradecenyl groups, various kinds of hexadecenyl groups, various kinds of octadecenyl groups, various kinds of nonadecenyl groups, various kinds of eicosenyl groups, various kinds of heneicosenyl groups, various kinds of docosenyl groups, various kinds of tricosenyl groups, various kinds of tetracosenyl groups, a cyclopentenyl group and a cyclohexenyl group.

Examples of the aryl group having from 6 to 24 carbon atoms include a phenyl group, a tolyl group, a xylyl group and a naphthyl group. Examples of the aralkyl group having from 7 to 24 carbon atoms include a benzyl group, a phenethyl group, a naphthylmethyl group, a methylbenzyl group, a methylphenethyl group and a methylnaphthylmethyl group.

The phosphate ester compound represented by the general formula (III) is preferably those having a hydrocarbon group having from 2 to 18 carbon atoms.

Specifically, examples of the acid phosphate monoester where m=1 include monoethyl acid phosphate, mono-n-propyl acid phosphate, mono-n-butyl acid phosphate, mono-2-ethylhexyl acid phosphate, monodecyl acid phosphate (monolauryl acid phosphate), monotetradecyl acid phosphate (monomyristyl acid phosphate), monopalmityl acid phosphate, monooctadecyl acid phosphate (monostearyl acid phosphate) and mono-9-octadecenyl acid phosphate (monooleyl acid phosphate).

Examples of the acid phosphate diester where m=2 include di-n-butyl acid phosphate, di-2-ethylhexyl acid phosphate, didecyl acid phosphate, didodecyl acid phosphate (dilauryl acid phosphate), di(tridecyl) acid phosphate, dioctadecyl acid phosphate (distearyl acid phosphate) and di-9-octadecenyl acid phosphate (dioleyl acid phosphate).

Examples of the phosphate triester where m=3 include a triaryl phosphate and a trialkyl phosphate, specific examples of which include benzyl diphenyl phosphate, triphenyl phosphate, tricresyl phosphate, tributyl phosphate, tridecyl phosphate, ethyl dibutyl phosphate and triethylphenyl phosphate.

Examples of the phosphite ester compound include a phosphite triester or acid phosphite ester compound represented by the general formulae (IV) and (V):

[Ka 2]

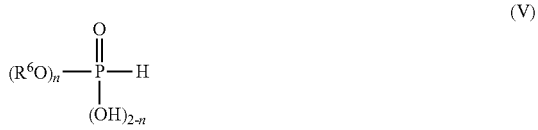

(IV)

(V)

wherein $R^6$ represents a hydrocarbon group having from 2 to 24 carbon atoms, and in the formula (V), n represents 1 or 2. When n is 2, plural groups of $R^6O$ may be the same as or different from each other.

Examples of the hydrocarbon group having from 2 to 24 carbon atoms represented by $R^6$ in the general formulae (IV) and (V) include the same ones as described for $R^5$ in the general formula (III).

The phosphite ester compound represented by the general formula (IV) is preferably those having a hydrocarbon group having from 2 to 18 carbon atoms.

Examples of the phosphite triester include triphenyl phosphite, triethyl phosphite, triisooctyl phosphite, tris-2-ethylhexyl phosphite, triisodecyl phosphite, tristridecyl phosphite and trioleyl phosphite.

Examples of the acid phosphite ester include di-n-butyl hydrogen phosphite, di-2-ethylhexyl hydrogen phosphite, didecyl hydrogen phosphite, didodecyl hydrogen phosphite (dilauryl hydrogen phosphite), dioctadecyl hydrogen phosphite (distearyl hydrogen phosphite), di-9-octadecenyl hydrogen phosphite (dioleyl hydrogen phosphite) and diphenyl hydrogen phosphite.

Examples of the thiophosphate ester compound include a thiophosphate triester or acid thiophosphate ester compound represented by the general formula (VI):

[Ka 3]

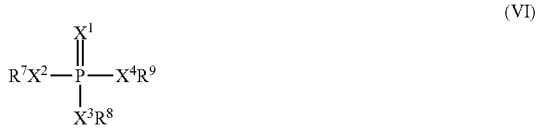

(VI)

wherein $R^7$ to $R^9$ each represent a hydrogen atom or a hydrocarbon group having from 2 to 24 carbon atoms, provided that at least one of them is the hydrocarbon group, and $X^1$ to $X^4$ each represent an oxygen atom or a sulfur atom, provided that at least one of them is a sulfur atom.

Specific examples of the compound include monobutyl thiophosphate, monooctyl thiophosphate, monolauryl thiophosphate, dibutyl thiophosphate, dioctyl thiophosphate, dilauryl thiophosphate, diphenyl thiophosphate, tributyl thiophosphate, trioctyl thiophosphate, triphenyl thiophosphate, trilauryl thiophosphate, dipropyl dithiophosphate and monopropyl dithiophosphate.

Examples of the thiophosphite ester compound include a thiophosphite triester or acid thiophosphite ester compound represented by the general formula (VII):

[Ka 4]

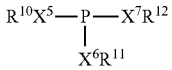

(VII)

wherein $R^{10}$ to $R^{12}$ each represent a hydrogen atom or a hydrocarbon group having from 2 to 24 carbon atoms, provided that at least one of them is the hydrocarbon group, and $X^5$ to $X^7$ each represent an oxygen atom or a sulfur atom, provided that at least one of them is a sulfur atom.

Specific examples of the compound include monobutyl thiophosphite, monooctyl thiophosphite, monolauryl thiophosphite, dibutyl thiophosphite, dioctyl thiophosphite, dilauryl thiophosphite, diphenyl thiophosphite, tributyl thiophosphite, trioctyl thiophosphite, triphenyl thiophosphite, trilauryl thiophosphite, tributyl trithiophosphite and tri(2-ethylhexyl)thiophosphite.

In the lubricating oil composition of the present invention, at least one kind of the phosphate ester compound may be used, at least one kind of the phosphite ester compound may be used, at least one kind of the thiophosphate ester compound may be used, at least one kind of the thiophosphite ester compound may be used, or a combination of these phosphorus-containing compounds may be used. Amine salts of the phosphorus-containing compounds may be used.

Preferred examples of the phosphorus-containing compound include a phosphate ester compound and a thiophosphate ester compound, specific examples of which include dipropyl dithiophosphate, monopropyl dithiophosphate, tridecyl phosphate and tricresyl phosphate.

In the present invention, the phosphorus-containing compound as the component (E) is mixed in a content of from 0.15 to 0.2% by mass, and preferably from 0.16 to 0.19% by mass, in terms of phosphorus atom based on the total amount of the gear oil composition. When the content is less than 0.15% by mass, it is difficult to decrease the friction coefficient under the boundary lubrication condition, and the effect of enhancing the extreme pressure properties is difficult to be provided. When it exceeds 0.2% by mass, the stability of the composition is deteriorated, which may cause precipitation.

The gear oil composition of the present invention is a gear oil composition having a mass ratio of sulfur atom to phosphorus atom (S/P) in the composition of from 8 to 11. In general, a sulfur-containing compound and a phosphorus-containing compound are used as an additive for a lubricating oil, such as an extreme pressure agent, and the present invention particularly utilizes the advantages provided by the combination of the phosphorus-containing compound as the component (E) and the organomolybdenum compound as the component (D), thereby achieving decrease of the friction coefficient under the boundary lubrication condition. The aforementioned mass ratio of sulfur atom to phosphorus atom is in the range for providing the advantages, and when the ratio is less than 8, it is difficult to decrease the friction coefficient under the boundary lubrication condition and to provide the effect of enhancing the extreme pressure properties. When the ratio exceeds 11, on the other hand, the similar defects occur in the same manner as in the case of less than 8, and the stability of the composition is deteriorated, which may cause precipitation. As an additive for a lubricating oil, a combination of a sulfur extreme pressure agent and a phosphorus extreme pressure agent is commercially available in the form of a gear oil additive package, and the additive package may be used in the present invention as far as the aforementioned conditions are satisfied.

In the present invention, the fuel saving properties are enhanced by paying attention to the kinematic viscosity, the friction coefficient under the boundary lubrication condition and the traction coefficient, and the extreme pressure properties, the shear stability and the wear resistance are enhanced by using the particular additives and utilizing the particular combination thereof. Accordingly, the gear oil composition of the present invention is remarkably enhanced in the seizing resistance, as compared to the case using ZnDTP (zinc dithiophosphate), which is an additive ordinarily used, as a main additive.

The gear oil composition of the present invention may contain appropriately other additives in such a range that the advantages of the present invention are not impaired.

Examples of the other additives include an antioxidant, an ashless dispersant, a metallic detergent, a viscosity index improver, a pour point depressant, a metal deactivator, a rust preventing agent and a defoaming agent.

Examples of the antioxidant include a phenol antioxidant, an amine antioxidant and a sulfur antioxidant.

Examples of the phenol antioxidant include 4,4'-methylenebis(2,6-di-t-butylphenol), 4,4'-bis(2,6-di-t-butylphenol), 4,4'-bis(2-methyl-6-t-butylphenol), 2,2'-methylenebis(4-ethyl-6-t-butylphenol), 2,2'-methylenebis(4-methyl-6-t-butylphenol), 4,4'-butylidenebis(3-methyl-6-t-butylphenol), 4,4'-isopropylidenebis(2,6-di-t-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-t-butyl-4-methylphenol, 2,6-di-t-butyl-4-ethylphenol, 2,4-dimethyl-6-t-butylphenol, 2,6-di-t-amyl-p-cresol, 2,6-di-t-butyl-4-(N,N'-dimethylaminomethylphenol), 4,4'-thiobis(2-methyl-6-t-butylphenol), 4,4'-thiobis(3-methyl-6-t-butylphenol), 2,2'-thiobis(4-methyl-6-t-butylphenol), bis(3-methyl-4-hydroxy-5-t-butylbenzyl)sulfide, bis(3,5-di-t-butyl-4-hydroxybenzyl)sulfide, n-octyl-3-(4-hydroxy-3,5-di-t-butylphenyl)propionate, n-octadecyl-3-(4-hydroxy-3,5-di-t-butylphenyl)propionate and 2,2'-thio[diethyl-bis-3-(3,5-di-t-butyl-4-hydroxyphenyl)propionate]. Among these, a bisphenol compound and an ester group-containing phenol compound are preferred.

Examples of the amine antioxidant include a monoalkyldiphenylamine compound, such as monooctyldiphenylamine and monononyldiphenylamine; a dialkyldiphenylamine compound, such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; a polyalkyldiphenylamine compound, such as tetrabutyldiphenylamine, tetrahexyldiphenylamine, tetraoctyldiphenylamine and tetranonyldiphenylamine; and a naphthylamine compound, such as α-naphthylamine, phenyl-α-naphthylamine and an alkyl-substituted phenyl-α-naphthylamine compound, e.g., butylphenyl-α-naphthylamine, penthylphenyl-α-naphthylamine, hexylphenyl-α-naphthylamine, heptylphenyl-α-naphthylamine, octylphenyl-α-naphthylamine and nonylphenyl-α-naphthylamine. Among these, a dialkyldiphenylamine compound and a naphthylamine compound are preferred.

Examples of the sulfur antioxidant include phenothiazine, pentaerythritol tetrakis(3-laurylthiopropionate), didodecyl sulfide, dioctadecyl sulfide, didodecyl thiodipropionate, dioctadecyl thiodipropionate, dimyristyl thiodipropionate, dodecyloctadecyl thiodipropionate and 2-mercaptobenzoimidazole.

The antioxidant may be used solely or as a mixture of two or more kinds thereof. For example, from the standpoint of the effect on oxidation stability, a mixture of one kind or two or more kinds of a phenol antioxidant and one kind of two or more kinds of an amine antioxidant is preferred.

The amount of the antioxidant added is generally preferably in a range of from 0.1 to 5% by mass, and more preferably from 0.1 to 3% by mass, based on the total amount of the gear oil composition.

Examples of the ashless dispersant include a succinic acid imide compound, a boron-containing succinic acid imide compound, a benzylamine compound, a boron-containing benzylamine compound, a succinate ester compound and a monobasic or dibasic carboxylic acid amide compound represented by a fatty acid and succinic acid.

Examples of the metallic detergent include a neutral metal sulfonate, a neutral metal phenate, a neutral metal salicylate and a neutral metal phosphonate of an alkaline earth metal such as calcium, a basic metal sulfonate, a basic metal phenate, a basic metal salicylate, a perbasic metal (for example, with a total base number of from 200 to 700 mgKOH/g) sulfonate, a perbasic metal salicylate and a perbasic metal phenate. The amount of the ashless dispersant and the metallic detergent added is generally from 0.1 to 20% by mass, and preferably from 0.5 to 10% by mass, based on the total amount of the gear oil composition.

Examples of the viscosity index improver include polymethacrylate, dispersed polymethacrylate, an olefin copolymer (such as an ethylene-propylene copolymer), a dispersed olefin copolymer and a styrene copolymer (such as a styrene-diene copolymer and a styrene-isoprene copolymer).

The amount of the viscosity index improver added is generally approximately from 0.5 to 15% by mass, and preferably from 1 to 10% by mass, based on the total amount of the gear oil composition, in view of the effect obtained by the addition thereof.

Examples of the pour point depressant include polymethacrylate having a weight average molecular weight of approximately from 5,000 to 50,000.

The amount of the pour point depressant added is generally approximately from 0.1 to 2% by mass, and preferably from 0.1 to 1% by mass, based on the total amount of the gear oil composition, in view of the effect obtained by the addition thereof.

Examples of the metal deactivator include a benzotriazole compound, a tolyltriazole compound, a thiadiazole compound and an imidazole compound.

The amount of the metal deactivator added is generally from 0.01 to 3% by mass, and preferably from 0.01 to 1% by mass, based on the total amount of the gear oil composition.

Examples of the rust preventing agent include a petroleum sulfonate, an alkylbenzene sulfonate, dinonylnaphthalene sulfonate, an alkenyl succinate ester and a polyhydric alcohol ester.

The amount of the rust preventing agent added is generally approximately from 0.01 to 1% by mass, and preferably from 0.05 to 0.5% by mass, based on the total amount of the gear oil composition, in view of the effect obtained by the addition thereof.

Examples of the defoaming agent include a silicone oil, a fluorosilicone oil and a fluoroalkyl ether, and the amount thereof is generally from 0.0005 to 0.5% by mass, and preferably from 0.01 to 0.2% by mass, based on the total amount of the gear oil composition, in view of the balance between the defoaming effect and the economy, and the like.

The gear oil composition of the invention is excellent in extreme pressure properties, shear stability and wear resistance, and is excellent in fuel saving properties, and the gear oil composition is favorably used, for example, as a gear oil for an automobile, an industrial gear oil and the like, and is particularly preferably used for lubrication of a differential gear of an automobile.

EXAMPLE

The present invention will be described in more detail with reference to examples below, but the present invention is not limited to the examples.

Examples 1 to 5 and Comparative Examples 1 to 6

Gear oil compositions having formulations (% by mass) shown in Table 1-1 were prepared. The properties thereof are shown in Table 1-2. The details of the components are as follows.

Mineral oil 1: mineral oil having a kinematic viscosity at 100° C. of from 4.47 $mm^2/s$ and a viscosity index (VI) of 127

Mineral oil 2: mineral oil having a kinematic viscosity at 100° C. of from 10.89 $mm^2/s$ and a viscosity index (VI) of 107

Mineral oil 3: mineral oil having a kinematic viscosity at 100° C. of from 4.284 $mm^2/s$ and a viscosity index (VI) of 116 OCP (olefin copolymer): copolymer of ethylene and propylene having a number average molecular weight of 7,700

PMA: polymethacrylate having a number average molecular weight of 21,000

Sulfur-containing compound: mixture of di-t-butyl disulfide and di-t-butyl trisulfide (mass ratio: 7/3)

Organomolybdenum compound: molybdenum dithiocarbamate having an alkyl group having 8 carbon atoms Phosphorus-containing compound: mixture of phosphate compounds (dipropyl dithiophosphate, monopropyl dithiophosphate, tridecyl phosphate and tricresyl phosphate)

Other additives: dispersant (polybutenyl succinic acid imide), friction controlling agent (oleic acid amide)

The properties of the mineral oils, the base oils and the gear oil compositions were measured in the following manners.

(1) Kinematic Viscosity

A kinematic viscosity at 40° C. and 100° C. was measured according to JIS K2283.

(2) Viscosity Index (VI)

It was measured according to JIS K2283.

(3) Contents of Sulfur Atom, Phosphorus Atom and Molybdenum Atom

They were measured by the ICP emission spectrometry.

TABLE 1-1

| | | Example | | | | |
|---|---|---|---|---|---|---|
| | | 1 | 2 | 3 | 4 | 5 |
| (A) | Mineral oil 1 | 50.4 | 41.9 | 39.0 | 50.8 | 50.4 |
| — | Mineral oil 2 | 32.2 | 39.2 | 46.1 | 32.5 | 32.4 |
| — | Mineral oil 3 | — | — | — | — | — |
| (B) | OCP | 7.0 | 8.5 | 4.5 | 7.0 | 7.0 |
| — | PMA | — | — | — | | — |
| (C) | Sulfur-containing compound | 4.4 | 4.4 | 4.4 | 3.7 | 4.4 |
| (D) | Organo-molybden-um com-pound | 0.50 | 0.50 | 0.50 | 0.50 | 0.25 |
| (E) | Phos-phorus-containing compound | 2.5 | 2.5 | 2.5 | 2.5 | 2.5 |
| — | Other additives | 3.0 | 3.0 | 3.0 | 3.0 | 3.0 |
| Total | | 100.0 | 100.0 | 100.0 | 100.0 | 100.0 |

| | | Comparative Example | | | | | |
|---|---|---|---|---|---|---|---|
| | | 1 | 2 | 3 | 4 | 5 | 6 |
| (A) | Mineral oil 1 | — | 47.5 | 50.9 | 50.3 | 50.2 | 50.1 |
| — | Mineral oil 2 | 34.6 | 30.1 | 32.0 | 32.0 | 31.6 | 31.6 |
| — | Mineral oil 3 | 48.0 | — | — | — | — | — |
| (B) | OCP | 7.0 | — | 7.0 | 7.0 | 7.0 | 7.0 |
| — | PMA | — | 12.0 | — | — | — | — |
| (C) | Sulfur-containing compound | 4.4 | 4.4 | 4.4 | 4.4 | 4.4 | 5.3 |
| (D) | Organo-molybden-um com-pound | 0.5 | 0.5 | 0.2 | 0.88 | 0.5 | 0.5 |
| (E) | Phos-phorus-containing compound | 2.5 | 2.5 | 2.5 | 2.5 | 3.3 | 2.5 |
| — | Other additives | 3.0 | 3.0 | 3.0 | 3.0 | 3.0 | 3.0 |
| Total | | 100.0 | 100.0 | 100.0 | 100.0 | 100.0 | 100.0 |

TABLE 1-2

| | | Example | | | | | Comparative Example | | | | | |
|---|---|---|---|---|---|---|---|---|---|---|---|---|
| | | 1 | 2 | 3 | 4 | 5 | 1 | 2 | 3 | 4 | 5 | 6 |
| Base oil | Amount of mineral oil with VI of 125 or more (% by mass) | 61.0 | 51.7 | 45.8 | 61.0 | 60.9 | 0.0 | 61.2 | 61.4 | 61.1 | 61.4 | 61.3 |
| | Viscosity index (VI) | 123 | 121 | 120 | 123 | 123 | 115 | 123 | 123 | 123 | 123 | 123 |
| Gear oil composition | Kinematic viscosity at 40° C. ($mm^2/s$) | 73.27 | 74.60 | 70.00 | 73.34 | 73.30 | 72.17 | 70.05 | 74.02 | 72.80 | 72.80 | 72.80 |
| | Kinematic viscosity at 100° C. ($mm^2/s$) | 11.65 | 11.95 | 11.40 | 11.60 | 11.64 | 11.6 | 11.75 | 11.60 | 11.70 | 11.70 | 11.70 |
| | Viscosity index | 153 | 156 | 149 | 152 | 153 | 145 | 164 | 151 | 156 | 156 | 156 |
| | Mass ratio of sulfur atom to phosphorus atom (S/P) | 10 | 10 | 10 | 8.4 | 9.5 | 10.0 | 10.0 | 10.0 | 10.0 | 7.6 | 12.1 |
| | Content of sulfur atom (% by mass) | 1.9 | 1.9 | 1.9 | 1.6 | 1.8 | 1.9 | 1.9 | 1.9 | 1.9 | 1.9 | 2.3 |
| | Content of phosphorus atom (% by mass) | 0.19 | 0.19 | 0.19 | 0.19 | 0.19 | 0.19 | 0.19 | 0.19 | 0.19 | 0.25 | 0.19 |
| | Content of molybdenum atom (ppm by mass) | 200 | 200 | 200 | 200 | 100 | 200 | 200 | 80 | 350 | 200 | 200 |

The gear oil compositions were subjected to various tests according to the following methods for evaluating the properties thereof. The evaluation results are shown in Table 2.

Falex Test

The change of frictional force and the wear amounts (pin and block) were measured with a Falex tester.

The measurement was performed according to ASTM D2625-83 with a test piece, SKH-51 (HRC65) for block or SUJ-2 (HRC60) for pin at a rotation number of 1,800 rpm, a load of 1,179 N, an oil temperature starting at 30° C. with no temperature control thereafter, and an oil amount of 100 mL. After the load and the rotation number reached the prescribed values, the frictional force and the wear amount after 1,200 sec were measured.

Shear Stability Test

The decreasing rate (%) of the kinematic viscosity at 100° C. after shearing was measured according to JPI-5S-29-88 (ultrasonic wave, Method A, 60 minutes, 30 mL).

High-Speed Timken Test

The maximum load that caused no seizing was obtained according to JIS K2519. The test was started at an initial load of 5 lbs increased stepwise, with a rotation number of 3,600 rpm and an oil temperature of 40° C. When seizing occurred, the load was lowered by 2.5 lbs, and when seizing did not occur, the load was increased by 2.5 lbs. The test was repeated to provide an acceptable load where no seizing occurred. The acceptable load is expressed in terms of the weight.

Storage Stability

The state of the gear oil composition after lapsing one day from the preparation was observed according to the following standard.

A: no cloud found, and no precipitation found

B: cloud found, but no precipitation found

C: precipitation found

TABLE 2

| | | Example | | | | |
|---|---|---|---|---|---|---|
| | | 1 | 2 | 3 | 4 | 5 |
| Falex test | Frictional force (N) | 250 | 255 | 250 | 260 | 250 |
| | Wear amount (mg) | 0.7 | 0.9 | 0.8 | 1.1 | 1.0 |
| Shear stability test (%) | | 0.60 | 0.70 | 0.35 | 0.60 | 0.60 |
| Traction coefficient | | 0.029 | 0.028 | 0.031 | 0.280 | 0.030 |
| High-speed Timken test: Acceptable load (lbs) | | 22.5 | 22.5 | 22.5 | 22.5 | 20.0 |
| Storage stability | | A | A | A | A | A |

| | | Comparative Example | | | | | |
|---|---|---|---|---|---|---|---|
| | | 1 | 2 | 3 | 4 | 5 | 6 |
| Falex test | Frictional force (N) | 250 | 260 | 350 | — | 400 | 420 |
| | Wear amount (mg) | 0.8 | 1.2 | 230 | — | 350 | 660 |
| Shear stability test (%) | | 0.60 | 6.00 | 0.60 | — | 0.60 | 0.60 |
| Traction coefficient | | 0.040 | 0.045 | 0.031 | — | 0.031 | 0.030 |
| High-speed Timken test: Acceptable load (lbs) | | 22.5 | 22.5 | 15.0 | — | 15.0 | 12.5 |
| Storage stability | | A | A | A | C | A | B |

Traction Coefficient

The traction coefficient was measured with MTM Traction Measuring Equipment.

The measurement conditions were as follows. The value at SRR of 20% was confirmed at a load of 20 N, an oil temperature of 100° C., a slide-roll ratio of from 1 to 90% and an average rotation speed of 2 m/s.

INDUSTRIAL APPLICABILITY

The gear composition of the present invention is excellent in extreme pressure properties (seizing resistance), shear stability and wear resistance, and is excellent in fuel saving properties, although reduction of the viscosity is achieved.

The invention claimed is:

1. A gear oil composition comprising:

(A) at least 81.1% by mass, based on the total amount of the composition, of a base oil having a viscosity index of 120 or more and comprising at least one member selected from the group consisting of a mineral oil having a kinematic viscosity at 100° C. of from 2 to 20 $mm^2/s$ and a polyolefin synthetic oil having a kinematic viscosity at 100° C. of from 2 to 20 $mm^2/s$;

(B) an ethylene-α-olefin copolymer having a number average molecular weight of from 3,000 to 8,000;

(C) a sulfur-comprising compound of formula (I):

$$R^1—S_x—R^2 \quad (I)$$

wherein $R^1$ and $R^2$ each independently represent a hydrocarbon group comprising from 4 to 16 carbon atoms, and x is an integer of from 2 to 4;

(D) an organomolybdenum compound represented by formula (II):

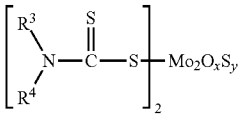

(II)

wherein $R^3$ and $R^4$ each represent a hydrocarbon group having from 4 to 24 carbon atoms, and x and y each represent a number of from 1 to 3, provided that the sum of x and y is 4; and (E) a phosphorus-comprising compound, comprising a hydrocarbon group comprising from 3 to 12 carbon atoms, which is selected from the group consisting of a phosphate ester compound, a phosphite ester compound, a thiophosphate ester compound, a thiophosphite ester compound, and a combination thereof, wherein the composition has a content of the component (B) of from 3 to 10% by mass, a content of the component (C) of from 1.2 to 2.0% by mass in terms of sulfur atom, a content of the component (D) of from 100 to 300 ppm by mass in terms of molybdenum atom, and a content of the component (E) of from 0.15 to 0.2% by mass in terms of phosphorus atom, based on a total amount of the composition, and wherein a mass ratio of sulfur atom to phosphorus atom (S/P) in the composition is from 8 to 11.

2. The composition of claim 1, wherein the base oil (A) comprises at least one selected from the group consisting of a mineral oil having a viscosity index of 125 or more and a polyolefin synthetic oil having a viscosity index of 125 or more, in a content of 40% by mass or more based on a total amount of the base oil.

3. The composition of claim 1, wherein the organomolybdenum compound (D) is at least one member selected from the group consisting of a molybdenum dithiophosphate and a molybdenum dithiocarbamate.

4. The composition of claim 2, wherein the organomolybdenum compound (D) is at least one member selected from the group consisting of a molybdenum dithiophosphate and a molybdenum dithiocarbamate.

5. The composition of claim 1, wherein the mineral oil is present and has a kinematic viscosity at 100° C. of from 4 to 13 $mm^2/s$.

6. The composition of claim 1, wherein the mineral oil is present and has a kinematic viscosity at 100° C. of from 6 to 11 $mm^2/s$.

7. The composition of claim 1, wherein the polyolefin synthetic oil is present and has a kinematic viscosity at 100° C. of from 4 to 13 $mm^2/s$.

8. The composition of claim 1, wherein the polyolefin synthetic oil is present and has a kinematic viscosity at 100° C. of from 6 to 11 $mm^2/s$.

9. The composition of claim 1, wherein the ethylene-α-olefin copolymer (B) comprises, in polymerized form, ethylene and propylene.

10. The composition of claim 1, wherein the ethylene-α-olefin copolymer (B) comprises, in polymerized form, ethylene and 1-butene.

11. The composition of claim 1, wherein the ethylene-α-olefin copolymer (B) comprises, in polymerized form, ethylene and 1-decene.

12. The composition of claim 1, wherein the ethylene-α-olefin copolymer (B) does not comprise a polar group.

13. The composition of claim 1, wherein the ethylene-α-olefin copolymer (B) is comprised in an amount of 4.5 to 8.5% by mass, based on the total amount of the composition.

14. A gear oil composition comprising:

(A) an effective amount of a base oil having a viscosity index of 120 or more;

(B) an ethylene-α-olefin copolymer having a number average molecular weight of from 2,000 to 10,000;

(C) a sulfur-comprising compound of formula (I):

$$R^1—S_x—R^2 \quad (I)$$

wherein $R^1$ and $R^2$ each independently represent a hydrocarbon group comprising from 4 to 16 carbon atoms, and x is an integer of from 2 to 4;

(D) an organomolybdenum compound; and (E) a phosphorus-comprising compound, wherein the composition has a content of the component (B) of from 3 to 10% by mass, a content of the component (C) of from 1.2 to 2.0% by mass in terms of sulfur atom, a content of the component (D) of from 100 to 300 ppm by mass in terms of molybdenum atom and a content of the component (E) of from 0.15 to 0.2% by mass in terms of phosphorus atom, based on a total amount of the composition, a mass ratio of sulfur atom to phosphorus atom (S/P) in the composition is from 8 to 11, said effective amount of said base oil is at least 81.1% by mass, based on the total amount of the composition;

said base oil comprises a mixture of i) a mineral oil having a kinematic viscosity at 100° C. of 4.47 $mm^2/s$ and a viscosity index of 127, and ii) a mineral oil having a kinematic viscosity at 100° C. of 10.89 $mm^2/s$ and a viscosity index of 107, where the viscosity index of the mixture is 120 or more;

said ethylene-α-olefin copolymer having a number average molecular weight of from 2,000 to 10,000 comprises a copolymer of ethylene and propylene having a number average molecular weight of 7,700;

said sulfur-comprising compound of formula (I) comprises a mixture of di-t-butyl disulfide and di-t-butyl trisulfide;

said an organomolybdenum compound comprises a molybdenum dithiocarbamate having an alkyl group having 8 carbon atoms; and said phosphorus-comprising compound comprises a mixture of dipropyl dithiophosphate, monopropyl dithiophosphate, tridecyl phosphate, and tricresyl phosphate.

15. The composition of claim 1, wherein said base oil comprises a mineral oil having a kinematic viscosity at 100° C. of from 2 to 20 $mm^2/s$;

said ethylene-α-olefin copolymer comprises a copolymer of ethylene and propylene;

said sulfur-containing compound is represented by said general formula (I) wherein x represents an integer of from 2 to 3 said organomolybdenum compound comprises a molybdenum dithiocarbamate (MoDTC);

said phosphorus-containing compound has a hydrocarbon group having from 3 to 12 carbon atoms selected from a phosphate ester compound and a thiophosphate ester compound.

16. The composition of claim 1, wherein said base oil comprises a mineral oil having a kinematic viscosity at 100° C. of from 4.284 to 10.89 $mm^2/s$;

said ethylene-α-olefin copolymer comprises a copolymer of ethylene and propylene having a number average molecular weight of from 3,000 to 8,000;

said sulfur-containing compound is represented by said general formula (I) wherein $R^1$ and $R^2$ each independently represent a hydrocarbon group having from 4 to 16 carbon atoms, and x represents an integer of from 2 to 3 said organomolybdenum compound is represented by the following general formula (II);

(II)

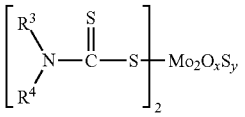

wherein $R^3$ and $R^4$ each represent a hydrocarbon group having from 4 to 24 carbon atoms, and x and y each represent a number of from 1 to 3, provided that the sum of x and y is 4;

said phosphorus-containing compound has a hydrocarbon group having from 3 to 12 carbon atoms selected from a phosphate ester compound and a thiophosphate ester compound.

17. The composition of claim 1, wherein said base oil comprises a mineral oil having a kinematic viscosity at 100° C. of from 4.284 to 10.89 $mm^2/s$;

said ethylene-α-olefin copolymer comprises a copolymer of ethylene and propylene having a number average molecular weight of 7,700;

said sulfur-containing compound is represented by said general formula (I) wherein $R^1$ and $R^2$ each independently represent a hydrocarbon group having 4 carbon atoms, and x represents an integer of from 2 to 3 said organomolybdenum compound is represented by the following general formula (II);

(II)

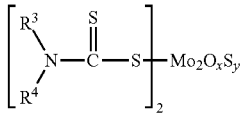

wherein $R^3$ and $R^4$ each represent a hydrocarbon group having 8 carbon atoms, and x and y each represent a number of from 1 to 3, provided that the sum of x and y is 4;

said phosphorus-containing compound has a hydrocarbon group having from 3 to 12 carbon atoms selected from a phosphate ester compound and a thiophosphate ester compound.

18. The composition of claim 1, wherein x in formula (I) is 2 or 3.

19. The composition of claim 1, wherein $R^1$ and $R^2$ in formula (I) each independently represent a hydrocarbon group comprising from 4 to 14 carbon atoms.

20. The composition of claim 1, wherein said phosphorus-comprising compound of component (E) comprises a hydrocarbon group comprising from 3 to 10 carbon atoms.

* * * * *